US005177292A

United States Patent [19]

Lenglet

[11] Patent Number: 5,177,292

[45] Date of Patent: Jan. 5, 1993

[54] METHOD FOR STEAM CRACKING HYDROCARBONS

[75] Inventor: Eric Lenglet, Marly Le Roi, France

[73] Assignee: Procedes Petroliers Et Petrochimiques, Marly Le Roi, France; a part interest

[21] Appl. No.: 623,881

[22] PCT Filed: Apr. 13, 1990

[86] PCT No.: PCT/FR90/00273

§ 371 Date: Dec. 12, 1990

§ 102(e) Date: Dec. 12, 1990

[87] PCT Pub. No.: WO90/12852

PCT Pub. Date: Nov. 1, 1990

[30] Foreign Application Priority Data

Apr. 14. 1989 [FR] France ..... 89 04986
Jul. 12. 1989 [FR] France ..... 89 09375
Oct. 6. 1989 [FR] France ..... 89 13070

[51] Int. Cl.[5] ..... C07C 4/04; B08B 9/04

[52] U.S. Cl. ..... 585/648; 134/7; 134/8; 134/22.11

[58] Field of Search ..... 585/648, 649, 650; 134/7, 8, 22.11; 208/48 R, 126, 130, 132

[56] References Cited

U.S. PATENT DOCUMENTS

| | | | |
|---|---|---|---|
| 1,939,112 | 12/1933 | Eulberg | 196/69 |
| 2,864,587 | 12/1958 | Broman | 134/7 |
| 4,203,778 | 5/1980 | Nunciato et al. | 134/7 |
| 4,297,147 | 10/1981 | Nunciato et al. | 134/7 |
| 4,482,392 | 11/1984 | Pollock et al. | 165/95 |
| 4,572,744 | 7/1986 | Dominick | 134/7 |
| 4,579,596 | 4/1986 | Murzyn | 134/7 |

*Primary Examiner*—Anthony McFarlane
*Attorney, Agent, or Firm*—Bell, Seltzer, Park & Gibson

[57] ABSTRACT

A method of steam cracking hydrocarbons in a steam cracking furnace (10) having tubes (12) connected to indirect quench menas (16) for the gaseous effluent leaving the furnace, the method consisting in allowing a layer of hard coke to form on the inside walls of the furnace tubes (12) and then in injecting a small quantity of solid erosive particles into the steam and hydrocarbon feedstock to be cracked, with the particles being separated from the gaseous effluent in a cyclone (28) provided at the outlet from the indirect quench means. The invention serves in particular to enable a steam cracking installation to operate continuously.

15 Claims, 3 Drawing Sheets

METHOD FOR STEAM CRACKING HYDROCARBONS

The invention relates to a method of steam cracking hydrocarbons, the method serving in particular to avoid or at least limit coking in the steam cracking installation.

The steam cracking of hydrocarbons consists in subjecting a feedstock of hydrocarbons mixed with steam to thermal cracking in an installation comprising, in particular, a furnace having tubes in which the feedstock is raised to a temperature of about 800° C. to 900° C., followed by indirect quench means for the gaseous effluent leaving the furnace, enabling the effluent to be cooled quickly in order to stop the cracking reactions.

The main drawback of this method lies in the installation becoming progressively caked with coke which is deposited in the furnace and in the indirect quench means.

A layer of coke whose thickness increases progressively is formed on the inside walls of the installation that come into contact with the feedstock to be cracked, and this layer is objectionable from the point of view of heat transfer and it also leads to an increase in the head losses inside the tubes of the furnace, and to a drop in yield.

It is therefore necessary from time to time to eliminate the coke that is deposited in such installations.

Proposals have already been made to do this by a chemical decoking method based on oxidization using an air-steam mixture. However, implementing this method requires the operation of the steam cracking installation to be interrupted and the equipment situated downstream to be isolated.

Proposals have also been made to decoke the indirect quench means by hydraulic sand blasting or by means of jets of water under very high pressure, thereby breaking up the layer of coke. Here again, it is necessary to interrupt the operation of the steam cracking installation completely.

Proposals have also been made to decoke by methods which consist essentially in injecting solid particles into the steam cracking installation. A first method consists in causing a flow of inert gas to flow while conveying metal particles of relatively large size (250 μm to 2,500 μm) through the furnace after it has been connected to the atmosphere. Another method proposes continuously sand blasting the steam cracking installation by injecting sand into the liquid hydrocarbon feedstock. The particles of sand pass through the steam cracking furnace and the indirect quench means and they are finally trapped by the heavy oil used for direct quenching of gaseous effluents. Since the mean diameter of sand particles is generally about 1 mm, this gives rise to significant erosion in the tubes conveying the feedstock and the steam cracking effluents. In addition, it is almost impossible to separate the particles of sand from the direct quenching heavy oil economically, and as a result the particles of sand cannot be recycled and the quenching oil becomes unuseable.

This means that the prior methods of steam cracking hydrocarbons are performed discontinuously, with periods of hydrocarbon steam cracking alternating with intervals during which the installations are decoked, thereby reducing yields and increasing costs.

A specific object of the invention is to provide a method of steam cracking hydrocarbons which is capable of being performed continuously over very long periods of time without it being necessary to stop steam cracking in order to decoke the corresponding installation.

Another object of the invention is to provide a method of this type enabling the formation of coke in the installation to be prevented or at least very greatly limited, without any risk of damaging the components of the installation.

To this end, the invention provides a method of steam cracking hydrocarbons, the method consisting in causing steam and hydrocarbon feedstock to flow high speed through an installation comprising at least one steam cracking furnace having tubes and indirect quench means for the gaseous effluents leaving the furnace, and in injecting erosive solid particles into the installation, with the particles being conveyed by a flow of gas to avoid or to limit the coking of said installation, the method being characterized in that it consists in adding said solid particles to the steam and hydrocarbon feedstock flowing through the installation after a layer of coke of sufficient mean thickness has already formed on the inside walls of the installation, in particular on the inside walls of the tubes of the furnace with erosive solid particles in sufficient quantity and of sufficient mass and dimension, so that the particles flowing through the furnace substantially preserve said layer of coke while eliminating by erosion at least the major portion of any coke tending to be deposited on said layer of coke as and when it is formed.

The method of the invention thus makes it possible to perform continuous steam cracking of hydrocarbons without it being necessary to stop the method periodically for decoking the steam cracking installation. In addition, the risk of damaging the components is avoided since the portions of these components which are subjected to the action of solid eroding particles are themselves covered in a protective layer of very hard material, which layer is advantageously constituted by the coke itself, with said layer being deliberately allowed to form on the inside walls of the installation. The quantities, dimensions, and/or masses of the solid particles injected into the installation are determined in such a manner that the erosion of the coke layer by these particles is nil or substantially negligible, while the newly formed coke which is deposited on this layer of coke is removed as and when it is formed.

After existing in the furnace for a period of several hours to several days and at a temperature close to 1000° C., the pre-layer of coke tends to harden by dehydrogenation and by calcination, and it is less easily eroded than newly-formed coke.

According to another characteristic of the invention, the method consists in measuring the head losses in at least some of the furnace tubes, in measuring the flow rate of the steam or hydrocarbon feedstock, in correcting the values of the head losses measured in the tubes as a function of the measured flow rate of the steam or hydrocarbon feedstock, and in regulating said head losses by varying the quantities of solid particles injected into the installation.

It is thus possible in a manner which is simple and relatively accurate to regulate the mean thickness of the layer of coke deposited on the inside walls of the installation, and to maintain it substantially equal to a predetermined value.

To do this, it is possible to maintain the corrected values of head loss in the tubes substantially equal to a value lying in the range about 130% to about 300% of the corrected head loss in a clean (non-coked) tube.

The mean thickness of the hardened coke layer protecting the inside walls of the furnace preferably lies in the range about 0.5 mm to about 4 mm.

This protective pre-layer of coke protects the walls of the tubes in the furnace. Likewise maintaining a pre-layer of coke on the walls of the quench boiler is not essential since the risks of the tubes being eroded therein are limited because of the very much lower flow speeds.

According to an advantageous further characteristic of the invention, the method also consists in increasing the hardness of said layer of coke by subjecting it, possibly cyclically, to an increase in temperature e.g. lying in the range 20° C. to 140° C. This increase in temperature above its temperature during subsequent steam cracking has the effect of increasing the hardness of the layer of coke.

It is also possible, while said layer of coke is being formed, to make the installation operate with special hydrocarbons that are different from those of the feedstock for the installation, for example to feed it with light hydrocarbons of the C1 to C4 type, such as ethane, for example.

This operation gives rise to a harder layer of coke being formed on the inside walls of the installation.

Thus, in accordance with the invention, it is possible to obtain a pre-layer of coke having increased hardness, thereby making it less fragile and increasing its protective effect on the metal of the tubes.

According to yet another characteristic of the invention, the mean diameter of the solid particles injected into the installation is less than about 250 μm, e.g. lying in the range 5 μm to 150 μm, and the mean throughput of particles injected into the installation is less than 10% by weight of the flow-rate of hydrocarbons and steam constituting the feedstock to be cracked.

This limited quantity of very fine particles causes the gas to be lightly erosive, thereby enabling newly-formed coke to be removed by multiple low-energy impacts, without breaking up the protective pre-layer of hardened coke.

According to another characteristic of the invention, the method also consists in separating the solid particles from the gaseous effluent leaving the indirect quench means by cyclone type gas-solid separator means, in storing said solid particles leaving the separation means in a tank, and in periodically connecting said tank to a source of gas under pressure and to a duct for injecting particles into the installation, thereby recycling the particles.

The use of one or more cyclones at the outlet from the indirect quench means makes it possible to separate the gaseous effluents and the solid particles with very high efficiency (the efficiency may be 99% or higher).

This also makes it possible to recover the solid particles and then recycle them through the installation after raising their pressure level.

The method of the invention also provides for injecting the solid particles into a manifold for feeding the tubes of the steam cracking furnace, in distributing the solid particles between these tubes by means of endpieces mounted at the ends of the tubes and projecting into the manifold, said endpieces having an inlet section pointing towards the upstream end of the manifold, and in obtaining a uniform distribution of solid particles between the tubes by extracting a fraction of the flow of solid particles and gas flowing along the manifold from the downstream end of the manifold.

This avoids irregular particle distribution in the various tubes of the steam cracking furnace, thereby ensuring uniform decoking of the tubes as and when coke is formed.

In addition, the flow of solid particles and gas which is extracted from the downstream end of the manifold is advantageously recycled to the upstream end thereof.

The invention will be better understood and other characteristics, details, and advantages thereof will appear more clearly on reading the following description given by way of example and made with reference to the accompanying drawings, in which:

DETAILED DESCRIPTION OF THE INVENTION

Figure 1:
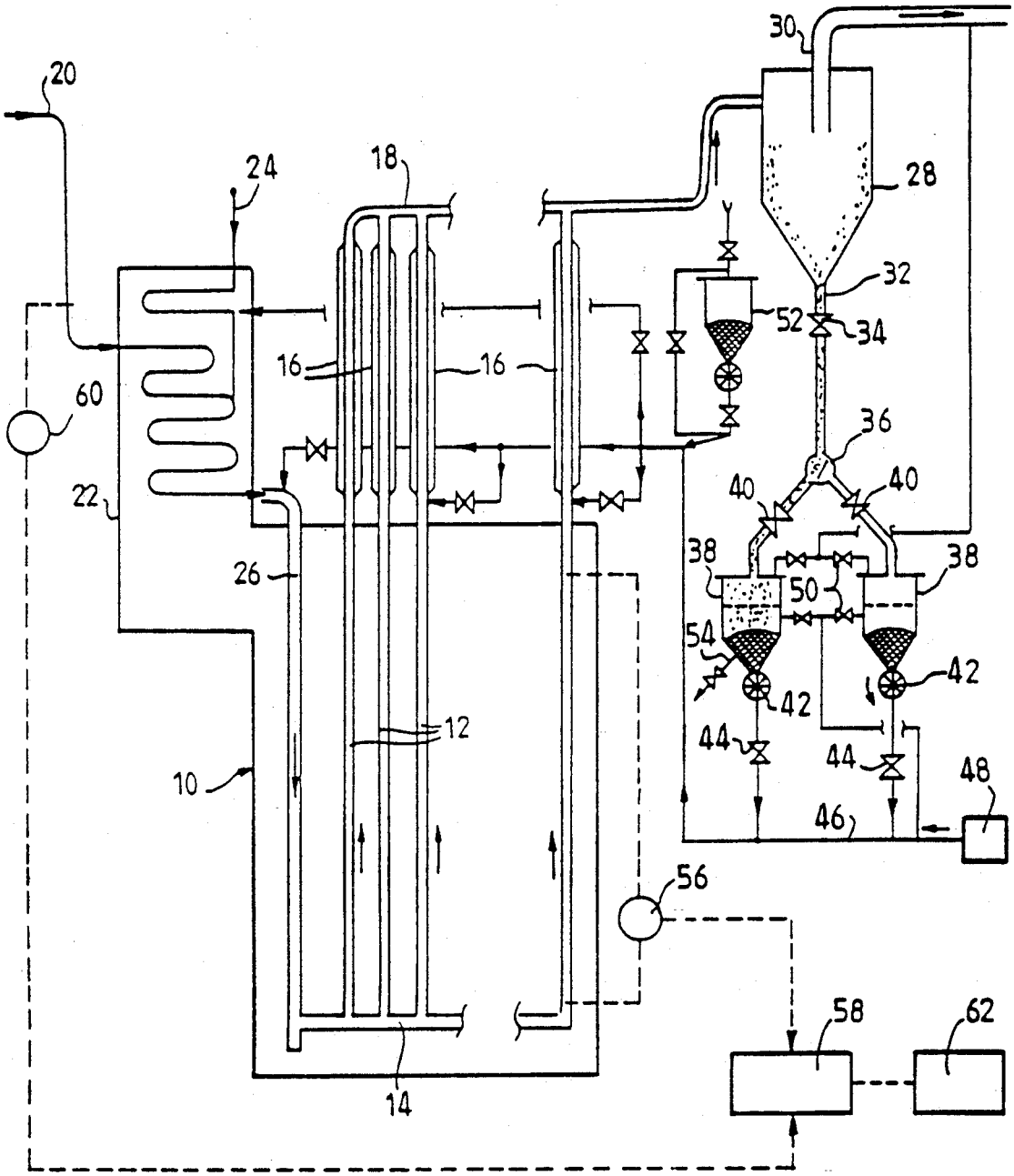
FIG. 1 is a diagram of a steam cracking installation suitable for performing the method of the invention.

The installation shown in FIG. 1 comprises a furnace 10 having single-pass tubes 12 each of which is connected at one end to a feed manifold 14 and each of which includes, an individual quench boiler 16 at its other end which is connected to an outlet manifold 18.

The hydrocarbon feedstock to be cracked is delivered in the liquid state via a duct 20 to a convection zone 22 of the furnace where it is heated and vaporized.

A steam feed duct 24 is connected to the duct 20 in said zone 22 of the furnace 10. A preheat duct 26 conveys the mixture of vaporized hydrocarbons and steam to the manifold 14 feeding the furnace tubes 12.

The outlet manifold 18 is connected to at least one cyclone 28 (or to a plurality of cyclones connected in series and/or parallel), with the, or each, cyclone including a top outlet duct 30 for gaseous effluents and a bottom outlet duct 32 for solid particles.

The bottom duct 32 is connected via a stop valve 34 and a flap valve 36 to two particle storage tanks 38 which are disposed in parallel. An isolating valve 40 is connected between each tank 38 and the flap valve 36.

Each tank 38 includes means, e.g. such as a vibrating screen, for separating out and retaining large particles, together with a removal orifice for such large particles (manhole).

The bottom portion of each tank 38 in which the fine solid particles collect is connected to a motor driven rotary member 42 (of the screw or rotary lock type) and via an isolating valve 44 to a duct 46 for recycling solid particles through the installation.

A source 48 of gas under pressure feeds the ducts 46 with a flow of gas at a relatively low mean speed (e.g. superheated steam flowing at 20 meters per second (m/s).

A system of valves 50 enables each tank 38 to be connected either to the source of gas under pressure 48 or else to the duct 30 via which the gaseous effluents leave the cyclone 28.

An independent tank 52 filled with new solid particles of determined mean grain size is used to inject topping-up particles into the recycling duct 46 via a motor driven rotary member and an isolating valve.

The top portion of the tank 52 is connected to the outlet from said tank by a duct which serves to balance pressures.

Each tank 38, or one of them, may include a purge duct 54 in its bottom portion for enabling a certain quantity of worn solid particles to be drawn off.

The recycling duct 80 is connected via stop valves to various different points in the steam cracking installation, in particular to the inlet of the duct 26, to the inlets of the indirect quench boilers 16, and to the duct 24 for cleaning the feedstock vaporization duct situated in the portion 22 of the furnace 10 (e.g. at the point where the hydrocarbon feedstock is completely vaporized).

The installation of FIG. 1 also includes means 56 for measuring real head losses in some of the furnace tubes 12, for the purpose of discovering the increase in head losses due to coke being deposited on the inside walls of the tubes. The head loss measuring means 56 are connected by a correction circuit 58 associated with means 60 for measuring the flow rate of the hydrocarbon feedstock (or of the steam) to a controlling logic circuit 62 serving to regulate the real head losses in the furnace tubes to a value lying in the range about 130% to about 300% of the value of said head losses in clean tubes and under the same conditions of furnace operation (same hydrocarbon feedstock and same steam flow rate). The real head loss in the furnace tubes, corrected as a function of flow rate, is preferably maintained at a value lying in the range about 130% and about 180% of the head loss in clean tubes.

The control circuit 62 can act on the following means:

- the quantity of topping-up solid particles delivered from the tank 52;
- the purging of one or more of the tanks 38 via the duct(s) 54; and
- the cycle frequency and the recycling flow rate of solid particles from the tanks 38.

The installation operates as follows:

The feedstock of hydrocarbons to be cracked is preheated, mixed with steam, and vaporized in the portion 22 of the furnace, after which it is subjected to steam cracking in the tubes 12 with a very short transit time in said tubes. The gaseous effluents of steam cracking are then subjected to indirect quenching of the boilers 16, and pass into the cyclone 28 from which they reach means for direct quenching by pyrolysis oil injection.

When the installation is first operated, or after it has been decoked by any suitable method, no solid erosive particles are injected into the feedstock of hydrocarbons and steam flowing through the installation. A relatively large amount of coke is formed on the inside walls of the duct 26, of the manifold 14, of all the furnace tubes 12, and of all the boiler tubes 16 relatively quickly. A protective layer of coke is thus allowed to form on all these walls, which layer hardens quickly and may have a mean thickness lying in the range 0.5 mm to 4 mm, or in the range 1 mm to 3 mm. The thickness of this layer of coke is monitored by the above-mentioned means 56 for measuring head losses in the tubes 12, and for correcting the measured values as a function of the flow rate of hydrocarbon feedstock or of steam.

When the corrected head loss in a furnace tube reaches a predetermined value lying in the range about 130% to about 300% of the head loss in a clean tube, it is considered that the layer of coke formed on the inside walls of the installation is of adequate thickness.

Advantageously, the hardness of this layer of coke may be increased by subjecting it to an increase in temperature (optionally cyclically) with the temperature increase lying in the range 20° C. to 140° C. To do this, the temperature of the skins of the tubes is allowed to increase either by reducing the flow rate of feedstock to be cracked or else by increasing the heating provided by the furnace. This gives rise to appreciable hardening of the layer of coke.

In a variant, an equivalent result is obtained by causing the installation to operate with light hydrocarbons (of C1 to C4 type) which are cracked at high temperature, or else by allowing the installation to operate with sulfur-containing compounds. The coke which is formed by cracking ethane, ethylene, propane, propylene, or sulfur-containing compounds, is harder than the coke formed by cracking more conventional feedstocks, such as naphtha and gas oil.

When the layer of coke deposited on the side walls of the installation has reached a determined mean thickness, and optionally after said layer of coke has been hardened by one of the above-mentioned methods, then erosive solid particles are injected into the installation and are entrained by the feedstock of hydrocarbons and steam, and the particles serve to eliminate newly-formed coke as and when it tends to be deposited on the above-mentioned layer of coke.

The quantities and dimensions and/or masses of the injected solid particles are determined so as to eliminate the newly-formed coke while leaving the protective layer already deposited on the inside walls of the installation unharmed.

Erosive solid particles are thus used having a mean diameter of less than about 250 μm, and preferably lying in the range 5 μm to 150 μm. The flow rate of these particles is less than 10% by weight of the steam and hydrocarbon feedstock, and is preferably between 0.1% and 8% by weight of said feedstock.

A mixture of two types of particles may be used, for example a first type of particles having a relatively small mean mass and grain size (e.g. in the range 5 μm to 100 μm) and a second type of particles comprising particles of greater mass. In this case, the heavier particles begin the erosion of the newly deposited coke while the finer and lighter particles propagate said erosion.

The solid particles used may be substantially spherical particles, e.g. made of silica-alumina, such as particles of catalyst that have already been used for catalytic cracking. It is also possible to use metal particles, e.g. particles of iron, steel, nickel, nickel alloy, etc., and other particles which are harder and more erosive (e.g. cracking catalyst particles or particles of a hard refractory metal alloy).

The solid particles flowing through the installation reach the cyclone(s) 28 in which they are separated from the gaseous effluents with very high efficiency, subsequently leaving each cyclone 28 via its bottom duct 32 to reach the tanks 38 alternately, with the flap valve 36 selecting which one of the tanks is used to store the particles. While one of the tanks is being used to store solid particles, the other tank 38 may be used for reinjecting the particles into the installation. To do this, the top isolating valve 40 of the tank is closed, the top portion of the tank is isolated from the gaseous effluent outlet duct 30 from the cyclone 28, and is connected to the source of gas under pressure 48, with the rotary member 42 being rotated and the bottom isolating valve 44 being open.

When this tank is empty, it may be used again for storing particles, and the solid particles stored in the other tank 38 are then recycled through the installation.

The operation of these storage and recycling means for solid particles is described in greater detail in another patent application filed by the same Applicants on the same day as the present patent application. Where necessary, the person skilled in the art may refer to this other patent application, with the description thereof being incorporated herein by reference.

Figure 2:
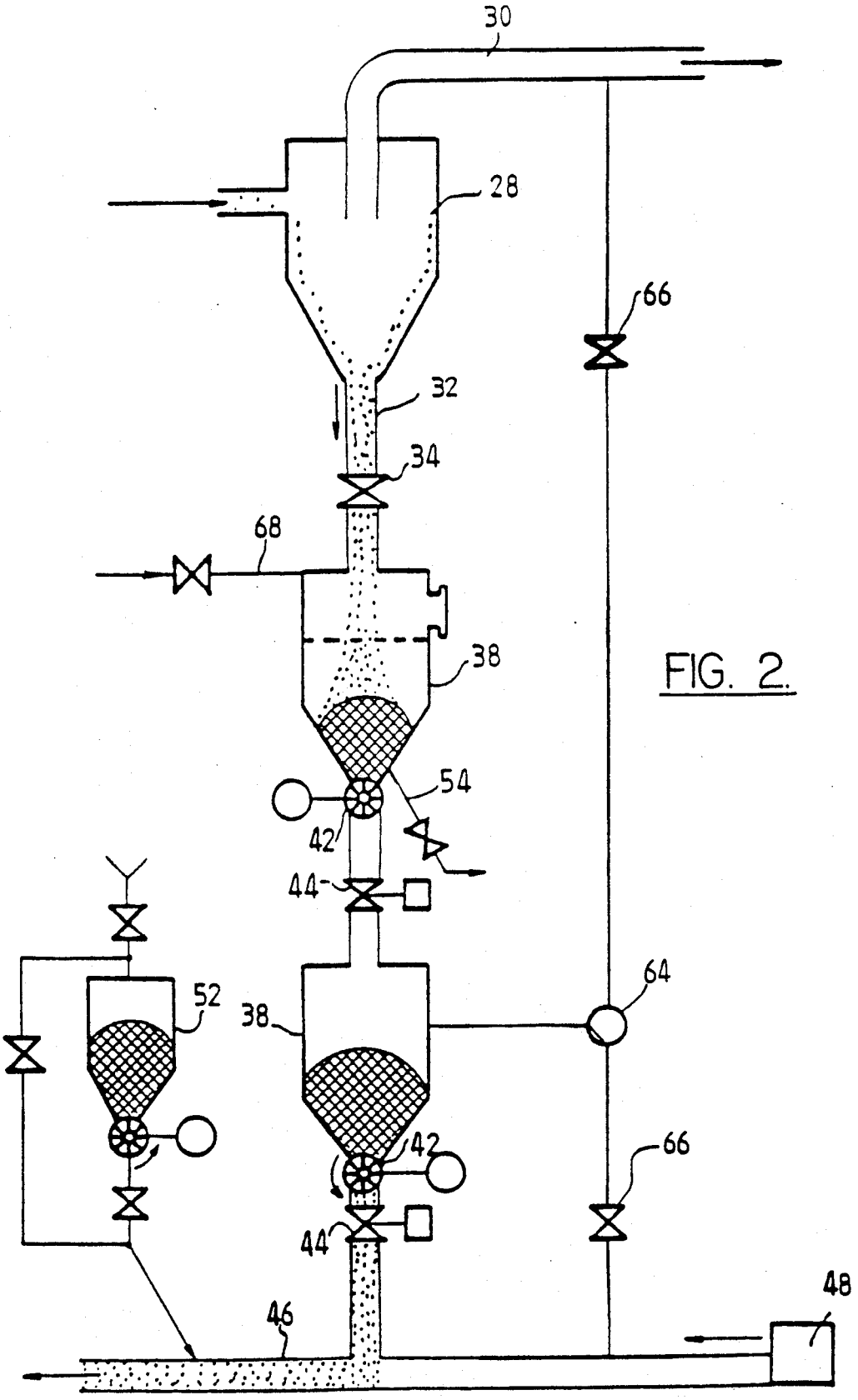
FIG. 2 is a diagram on a larger scale showing a variant embodiment of a portion of said installation.

FIG. 2 shows a variant of the means for storing and recycling solid particles. The means shown in FIG. 2 differ from those shown in FIG. 1 in that the two tanks 38 are now disposed in series instead of in parallel. In addition, a three-way valve 64 serves to connect the bottom tank 38 either to the source of gas under pressure 48 via a stop valve 66, or to the gaseous effluent outlet duct 30 from the cyclone 28 via a different stop valve 66.

A duct 68 is also provided for delivering a barrage gas, which duct opens out into the top portion of the top tank 38. The barrage gas is free from heavy aromatic compounds and it may be steam. It serves to prevent coking taking place in the top tank 38 and in its filter screen by preventing any cracked gases being present therein.

Otherwise, the means are the same as those described above with reference to FIG. 1 and the operation of this variant is substantially identical to that of the corresponding means of FIG. 1, with the two tanks 38 still being used alternately for storing and recycling solid particles.

In the event that the gaseous effluents penetrating into the cyclone do include traces of liquid, then solid particles may be separated out in the cyclone in two stages:

- a first stage in which the gaseous effluents are dried (e.g. at the outlet from a first cyclone by being mixed with a flow of superheated gas and/or by recycling hot dry particles); and
- a second stage in which the dried particles are separated out.

Figure 3:
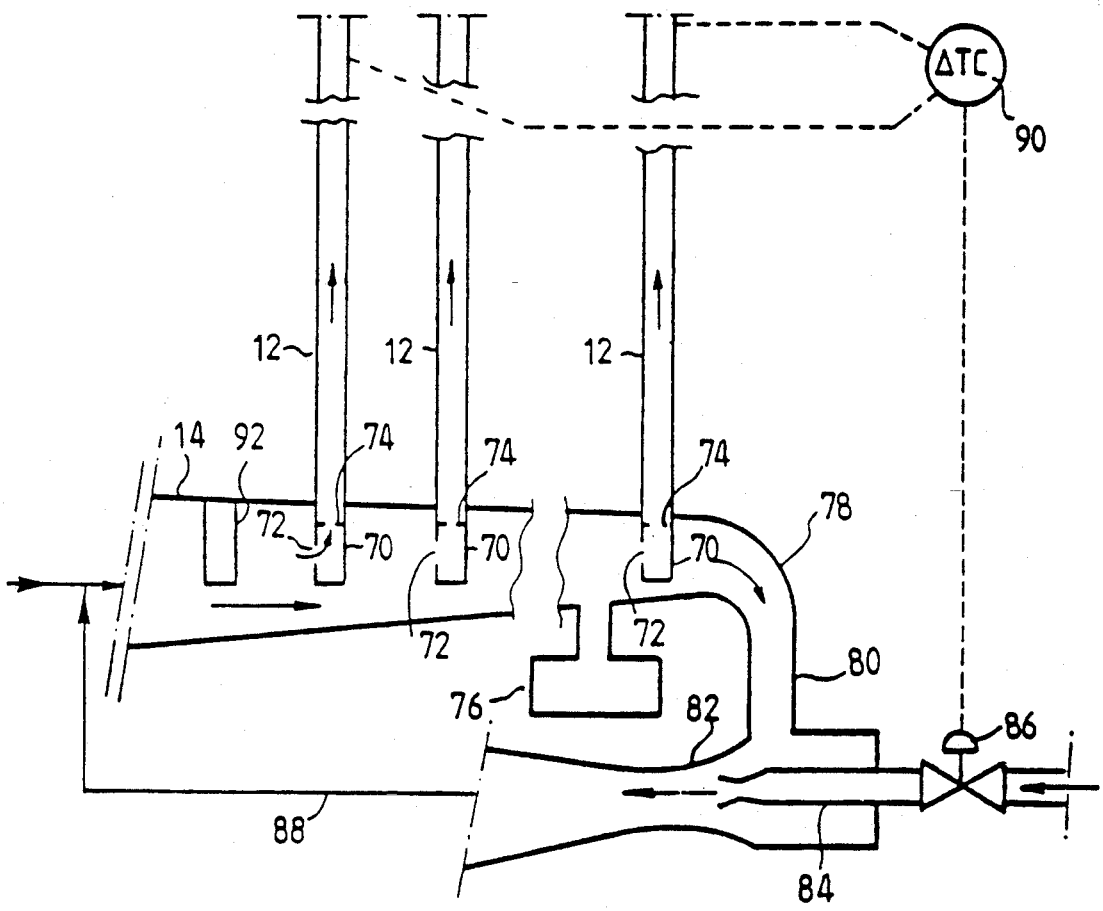
FIG. 3 is a diagram showing means for distributing erosive solid particles amongst the tubes of a steam cracking furnace.

FIG. 3 shows the means for distributing the solid particles uniformly amongst the various tubes 12 of the steam cracking furnace. The feed manifold 14 for the tubes 12 receives steam and vaporized hydrocarbon feedstock at its upstream end, e.g. at a temperature of about 550° C., and having a small quantity of solid particles injected therein.

The furnace tubes 12 constitute one or more parallel rows opening out at regular intervals into the manifold 14. The section of the manifold tapers progressively from its upstream end towards its downstream end in the flow direction of the feedstock, thereby maintaining a minimum speed for the mixture inside the manifold and preventing solid particles being deposited.

The end of each tube 12 opening out into the manifold 14 includes a feed nozzle 70 situated inside the manifold and having an inlet section with an orifice 72 directed towards the upstream end of the manifold. Immediately downstream from its feed nozzle 70, the section of each tube 12 includes a narrowing 74 such as a throat or a venturi, thereby making the gas flow rate into the various tubes 12 uniform and substantially constant. Advantageously, a sonic venturi is used.

A settling chamber 76 is provided upstream from the last tube 12 and underneath the manifold 14, and serves to receive solid particles moving along the bottom generator line of the manifold 14.

The downstream end 78 of the manifold is connected by a duct 80 of suitable dimensions to an ejector-compressor 82 comprising an axial duct 84 delivering a flow of driving gas such as steam. A valve 86 serves to adjust the flow rate of this driving gas. The outlet from the ejector-compressor 82 is connected by a duct 88 to the upstream end of the manifold 14 or to the duct feeding it with the hydrocarbon feedstock.

Advantageously, the valve 86 for adjusting the flow rate of the driving gas may be controlled by a system 90 including means for detecting the skin temperatures of the first and the last tubes 12 in the furnace and serving to servo-control the flow rate of the driving gas to the difference between these temperatures.

This apparatus operates as follows:

the mixture of vaporized hydrocarbons, steam, and solid particles flows with a high degree of turbulence inside the manifold 14. The mean flow speed inside the manifold lies in the range 20 m/s to 120 m/s, e.g. between 30 m/s and 80 m/s, and is considerably lower than the flow speed inside the tubes 12 which lies in the range about 130 m/s to about 300 m/s (and in particular in the range 160 m/s to 270 m/s).

The flow speed inside the manifold 14 is sufficient to prevent any gas-solid separation taking place inside the manifold except for certain heavy particles which may move along the bottom generator line of the manifold.

By extracting a fraction of the solid particle and gas flow from the downstream end of the manifold, the manifold is transformed into a manifold of infinite length, thereby ensuring that the downstream end of the manifold has no significant influence on the distribution of particle and gas flow in the various tubes 12, regardless of whether the tubes are close to or far from the downstream end of the manifold.

The delivery of a flow of driving gas, e.g. steam, into the ejector 82 serves to extract the desired fraction of the solid-gas flow from the manifold and to recompress this fraction ready for recycling by injection into the upstream end of the manifold. The system 90 serves to regulate the flow of driving gas by acting on the valve 86, thereby regulating the feed of solid particles to the earlier tubes compared with the feed to the later tubes, and thus correcting possible irregularities in distribution as may be detected by the differences between the skin temperatures of these tubes.

The section narrowings 74 formed in the upstream ends of the tubes 12 have the effect of making the gaseous flows along these tubes uniform and substantially constant. This makes it possible to provide automatic regulation of the cleaning of these tubes by the solid particles. If a tube clogs excessively, in particular by becoming partially obstructed with coke, then the fact that the gaseous flow rate is kept constant by the narrowings 74 leads to the flow speed being increased, thereby increasing the erosive effectiveness of the particles.

In order to ensure that the gas and particle flow rate is properly and uniformly distributed amongst the various tubes, a fake feed nozzles 92 is provided upstream from the first tube, which nozzle is identical to the feed nozzles 70 of said tube. The first tubes 12 are thus, aerodynamically speaking, in the same situation as the following tubes.

The invention thus makes it possible to operate steam cracking installations continuously or substantially continuously, and it is applicable to various types of furnace, in particular to single-pass furnaces, having rectilinear tubes, and to multiple-pass furnaces having right angle bends.

I claim:

1. A method of steam cracking hydrocarbons in an installation comprising at least one steam cracking furnace having tubes and indirect quench means for the gaseous effluents leaving the furnace, said method comprising:

a) feeding a mixture of steam and hydrocarbon feedstock through the tubes and quench means so as to form a layer of coke in the tubes of mean thickness sufficient to protect the walls of the tubes from the erosive action of solid particles; and thereafter b) feeding a mixture of steam and hydrocarbon feedstock through the tubes coated with the coke layer formed in step (a) while simultaneously injecting into the tubes a flow of gas containing erosive solid particles in sufficient quantity and of sufficient mass and dimension to substantially limit by erosive action further deposition of coke while preserving the coke layer formed in step (a).

2. The method of claim 1, further comprising the steps of:

a) measuring the head losses in at least some of the furnace tubes and determining a value therefor;

b) measuring the flow rate of one of the components of the mixture of steam and hydrocarbon feedstock;

c) correcting the values of the head losses measured in the tubes as a function of the measured flow rate of one of the components of the mixture of steam and hydrocarbon feedstock; and d) regulating the head losses by varying the quantities of solid particles injected into the installation.

3. The method of claim 2, wherein the corrected head loss measurements in the tubes are maintained substantially equal to a value lying in the range of from about 130% to about 300% of the corrected head loss in a non-coked tube.

4. The method of claim 1 wherein the mean thickness of the layer of coke lies in the range of from about 0.5 mm to about 4 mm.

5. The method of claim 1 further comprising increasing the hardness of said layer of coke by subjecting it to a temperature rise lying in the range of from 20° C. to 140° C. above the temperature of the layer during subsequent steam cracking.

6. The method of claim 1 wherein said layer of coke is formed by introducing hydrocarbons into the tubes that are selected from among the group consisting of C1, C2, C3, and C4 hydrocarbons and sulfur compounds.

7. The method of claim 6 wherein said layer of coke is formed by introducing hydrocarbons into the tubes that are selected from among the group consisting of ethane, ethylene, propane, propylene, and sulfur compounds.

8. The method of claim 1 wherein the hydrocarbon is ethane.

9. The method of claim 1 wherein the solid particles injected into the installation have a mean diameter of less than about 250 μm. and the mean flow rate of particles injected into the installation is less than 10% by weight of the flow rate of steam and hydrocarbons to be cracked.

10. The method of claim 9 wherein the solid particles injected into the installation have a mean diameter in the range of from 5 μm to 150 μm.

11. The method of claim 1 further comprising the steps of:

(a) separating the solid particles from the gaseous effluent leaving the indirect quench means by gas-solid separator means;

(b) storing the solid particles leaving the separator means in a tank; and (c) periodically connecting the tank to a source of gas under pressure and to a duct for injecting particles into the installation, thereby recycling the particles.

12. The method of claim 11 further comprising storing the solid particles at the outlet from the separator means in two tanks.

13. The method of claim 12 wherein the tanks are disposed in parallel.

14. A method according to claim 1 further comprising the steps of:

(a) causing the solid particles to pass along a feed manifold of the tubes of the steam cracking furnace;

(b) distributing the solid particles amongst the tubes by means of nozzles provided at the ends of the tubes and projecting into the manifold, said nozzles having an inlet section facing towards the upstream end of the manifold;

(c) extracting from the downstream end of the manifold a fraction of the flow of gas and solid particles flowing along the manifold, thereby obtaining a uniform distribution of solid particles between the tubes.

15. The method of claim 1 further comprising causing two types of particles having substantially different masses to flow through the installation.

* * * * *